US007495189B2

(12) United States Patent
Christmann et al.

(10) Patent No.: US 7,495,189 B2
(45) Date of Patent: Feb. 24, 2009

(54) MINIATURE CIRCUIT BREAKER

(75) Inventors: Jurgen Christmann, Bammental (DE); Ralf Weber, Heidelberg (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 11/502,522

(22) Filed: Aug. 11, 2006

(65) Prior Publication Data

US 2007/0034495 A1 Feb. 15, 2007

(30) Foreign Application Priority Data

Aug. 12, 2005 (DE) ..... 10 2005 038 149

(51) Int. Cl.
*H01H 5/00* (2006.01)

(52) U.S. Cl. ..... 200/400; 200/306

(58) Field of Classification Search ..... 200/400
See application file for complete search history.

(56) References Cited

U.S. PATENT DOCUMENTS

| | | | | |
|---|---|---|---|---|
| 5,753,878 | A * | 5/1998 | Doughty et al. | 218/157 |
| 7,009,129 | B2 * | 3/2006 | Vierling | 200/400 |
| 7,115,829 | B2 * | 10/2006 | Schmid | 200/400 |
| 2005/0269195 | A1 * | 12/2005 | Brandon et al. | 200/400 |
| 2006/0070864 | A1 * | 4/2006 | Ferreira et al. | 200/400 |

FOREIGN PATENT DOCUMENTS

| | | |
|---|---|---|
| DE | 11 92 730 | 5/1965 |
| DE | 94 22029 | 9/1997 |
| EP | 0 255 483 | 2/1988 |
| EP | 0 549 072 | 6/1993 |

* cited by examiner

*Primary Examiner*—Elvin G Enad
*Assistant Examiner*—Lheiren Mae A Anglo
(74) *Attorney, Agent, or Firm*—Buchanan Ingersoll & Rooney PC

(57) ABSTRACT

A miniature circuit breaker is disclosed with a latch for continuously opening and closing a contact point with a contact lever on which the moving contact member is molded. A toggle lever gear with a link connected to a switching handle and a coupling element are provided, the coupling element connecting the link with the contact lever, which toggle lever gear can be brought from a first stable position (switched-on position) into a second stable position via a dead-center position by a tripping mechanism. The contact lever can be rotated and the contact point can be permanently opened. A compression spring is provided which acts on the link, the force of which acts approximately in a direction of the longitudinal extent of the link in the switched-off position, and thus at the beginning of the switching-on process, and transversely thereto in the switched-on position.

1 Claim, 1 Drawing Sheet

MINIATURE CIRCUIT BREAKER

RELATED APPLICATIONS

The present application claims priority under 35 U.S.C. §119 to German Application No. 10 2005 038 149.9 filed Aug. 12, 2005, the contents of which are hereby incorporated by reference in their entirety.

BACKGROUND

The invention relates to a miniature circuit breaker with a latch.

A miniature circuit breaker with a latch is known per se. The latch comprises a toggle lever gear which has a link which is in each case connected in an articulated manner with a switching handle and a coupling element; the coupling element connects the link with the contact lever also in an articulated manner. In the switched-on state, the gear is in a first stable position from which the gear can be brought into a second stable position via a dead-center position by means of a tripping mechanism; in this second position, the contact lever is rotated in the switched-off direction and the contact point is permanently opened. The tripping mechanism used could be an electromagnetic or thermal trip, the latter in the form of a thermal bimetallic strip or a strip of a shape-memory alloy.

So that the toggle lever gear can be moved from its first stable position to its second stable position, a specific force is applied which essentially depends on the force with which the coupling element acts on the contact lever.

SUMMARY

A miniature circuit breaker is disclosed, in which the ratios of force are advantageously influenced.

In an exemplary embodiment, a compression spring is provided which acts on a link and the force of which acts approximately in a direction of the longitudinal extent of the link in the switched-off position, and thus at the beginning of the switching-on process, and transversely thereto in the switched-on position.

In a particularly advantageous embodiment, the compression spring can be a helical spring supported on the switching handle, with a molded-on, radially protruding arm which rests elastically against the link.

At the end at the switching toggle, an approximately circular-arc-shaped cam interacting with the elastic arm can be arranged in an exemplary embodiment, with this cam face being molded on at a head in accordance with a further embodiment; in the switched-off position, the arm is located outside the cam face and during the switching-on process, it slides into the area of the cam face.

According to a further advantageous embodiment, the head can have an approximately triangular shape, the center axis or center line of the head extending transversely to the link, in such a manner that the elastic arm exerts a first force on the link in the switched-off state and a second force in the switched-on state, the first force extending at a distance from the pivot axis of the link at the switching handle and the second force extending transversely to the longitudinal extent of the link through the pivot point.

BRIEF DESCRIPTION OF THE DRAWINGS

Advantageous embodiments and improvements will be explained in greater detail and described with reference to the drawing, in which an illustrative embodiment is shown and in which.

DETAILED DESCRIPTION

Figure 1:
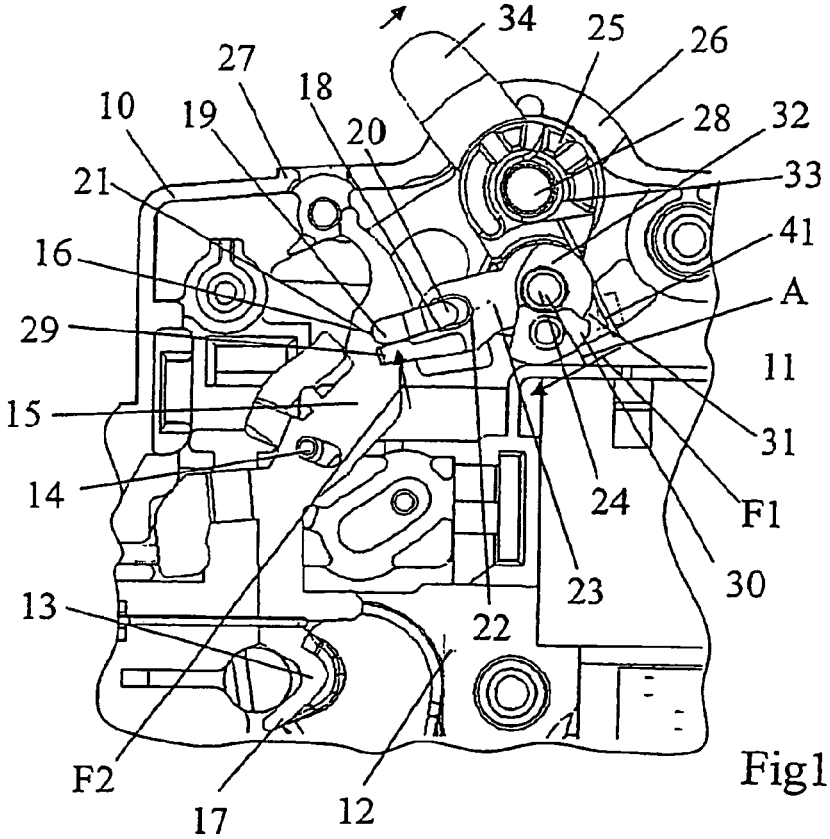
FIG. 1 shows a partial view of a miniature circuit breaker in the area of the latch in the switched-off position.

Reference will now be made to FIG. 1.

Within a housing 10 of a miniature circuit breaker 11, fixed contact member 12 is located which interacts with a moving contact member 13 which is arranged at a contact lever 15 which is rotatably supported on a bearing stud 14. The contact lever 15 is a double-arm lever with a first contact lever arm 16 and a second contact lever arm 17; on the latter, the moving contact member 13 is molded on. At the contact lever arm 16, a coupling element 18 is pivoted which has a U shape with two legs 19 and 20 protruding into the plane of the drawing. The leg 19 engages in a hole 21 in the contact lever whereas the other leg 20 engages in an elongated hole 22 in a link 23, the other end of which interacts, via a fulcrum pin 24, with a switching handle 34 which protrudes out of a cutout 26 in the front wall 27. The switching toggle 25 is rotatably supported about a stationary axle 28 in the housing 10. A tripping mechanism 60 is provided to separate the moving contact member 13 from the fixed contact member 12.

As can be seen from FIG. 1, the link 23 has a protrusion 29 which covers the leg 19 so that the leg 19 guides the link in the switched-on state.

At the end of the link 23 at the switching handle, a link head 30 is located which has a triangular circumferential contour, the circumferential contour being provided with a circular-arc-shaped cam face 31, the center of the circle of which coincides with the center of the fulcrum pin 24. The bisecting midline of the head 30 extends transversely to the longitudinal extent of the axis 23, the wider section of the head being directed into the inside of the switch; the narrower area forming a type of point 32 points towards the front 27.

At the switching toggle 25, a spring 33 is arranged which acts as torsion spring between the switching toggle 25 and the link 23 and which is adjoined by an spring arm 41 which interacts with the head 30, as follows:

In the switched-off position as shown in FIG. 1, the leg or arm approximately extends in the direction of the longitudinal extent of the switching handle 34 of the switching toggle 25 and approximately in the longitudinal direction of the bisecting midline or line of symmetry of the head 30. The arm 41 is thus located outside the cam face 31 and presses against the head 30, and thus against the link 23, with a force $F_1$, the force vector of the force $F_1$ passing the fulcrum pin 24 at a distance A perpendicularly to the arm 34 so that the force exerts, via the distance A which can be called a lever arm, a torque on the link 23 which tends to rotate the link clockwise around the fulcrum pin 24. In the switched-off state, a force $F_2$ is exerted on the leg 19 via the protrusion 29.

A compression spring which is used as contact pressure spring is arranged between a stationary stop, in this case a front narrow side wall 10*a*, and the contact lever arm 17.

Figure 2:
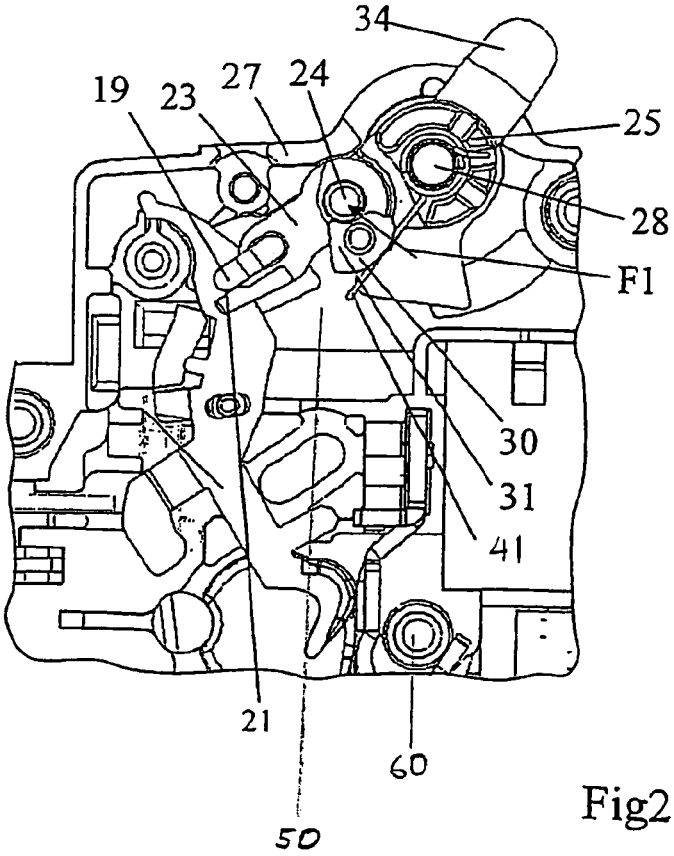
FIG. 2 shows the miniature circuit breaker according to FIG. 1 in the same drawing representation in the switched-on position.

The toggle lever gear 50 is shown in the first stable position both in FIG. 1 and in FIG. 2, the toggle lever gear 50 being moved to a second stable position via a dead-center position during the switching-off process, from which it is brought back into the position according to FIG. 2, in which the switching-on movement of the switching handle is transferred via the toggle lever gear 50 to the contact lever, by the spring force of the arm 41.

It should be added that the fulcrum pin 24 lies on a line which extends perpendicular to the front wall 27 with respect to the mounting plane, not shown in greater detail. As indicated, the force $F_1$ extends outside the area between the fulcrum pin 28 and the fulcrum pin 24.

When the switch is to be moved to the switched-on position, the switching handle 34 is rotated clockwise about its stationary axle 28 so that it moves to the position according to FIG. 7. As a result, the connecting point or the fulcrum pin or hinge pin 24 moves along a circular path about the axis 28 in he direction of the front wall in accordance with the rotation of the switching handle 34. The arm 41 slides under the cam face 31, with reference to the front wall 27, so that the force $F_1'$, which extends perpendicularly to the arm 31, presses on the head 30 in the area of the cam face 31, the arrangement being made in such a manner that the course of the force $F_1$ is now directed towards the front wall. As a result, the force $F_1'$ extends through the fulcrum pin 24 or the pivot pin with which the link is pivoted on the switching toggle 25. As a result, the link 23 becomes free of torque so that a force corresponding to the force $F_2$ in the switched-off state no longer acts on the leg 19 so that only the latching force needs to be transferred there.

In the switched-off state, the compression spring does not act on the toggle lever since the rotatable contact lever rests against a housing stop. One leg 20 of the coupling element 18 is thus located free of force in the elongated hole 22 of the link 23 and has play. Without the spring or the spring arm 41, respectively, the position of the coupling element 18 with respect to the link 23 is not precisely determined. In the worst case, the toggle could snap through towards the bottom between the coupling element 18 and the link 23 so that an obtuse angle open towards the front wall forms between the coupling element 18 and the link 23. The toggle angle would thus be negative and it would snap through when switching on. Due to the action of the spring force $F_1$ and the torque thus generated on the link 23 about the fulcrum pin 24, the spring arm 41 is always pressed into its maximum end position via the link 23 which ensures that the force is transmitted in the longitudinal direction. It prevents the toggle from snapping through both during switching-on and during switching-off. In the switched-on state, the compression spring produces a stable toggle and the force $F_1'$ of the arm 41 is not needed and can thus pass through the fulcrum pin 24.

The force $F_1$ is called the "first force" and the force $F_1'$ the "second force".

It must be added that the force $F_1$ extends perpendicularly to he longitudinal extent of the switching handle 34 and II the direction of the moving contact member, according to the end position of the switching toggle 25, the arm 41 extends approximately in the longitudinal extent of the switching handle 34 both in the position according to FIG. 1 and in the position according to FIG. 2.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. Miniature circuit breaker including a latch for continuously opening and closing a contact point comprising:

a contact lever on which a moving contact member is molded;

a switching handle connected to a link with a toggle lever gear;

a coupling element connecting the link with the contact lever;

a tripping mechanism by which the toggle lever gear can be brought from a first stable switched-on position into a second stable switched-off position via a dead-center position, the contact lever being rotated and the contact point being permanently opened; and a spring which acts on the link, a force of which acts approximately in a direction of a longitudinal extent of the link in the switched-off position, and at the beginning of a switching-on process, and transversely thereto in the switched-on position, wherein the spring is a helical spring supported on the switching handle, with a molded-on, radially protruding arm which rests elastically against the link, the link has at an end at the toggle lever gear an approximately circular-arc-shaped cam face interacting with the radially protruding arm, the circular-arc-shaped cam face is molded on at a head, the radially protruding arm being located outside the cam face in the switched-off position and sliding into an area of the cam face during the switching-on process, and wherein the head has an approximately triangular shape, a center axis of the head extending transversely to the link in such a manner that the radially protruding arm exerts a first force on the link in the switched-off position and a second force in the switched-on state, the first force exerting a torque on the link as a result of which the toggle lever gear presses into the second stable switched-on position in the switched-off position and the second force extending through the pivot axis of the link at the switching handle when the moving contact member is in its switched-on position.

* * * * *